US006561897B1

(12) United States Patent
Bourbour et al.

(10) Patent No.: US 6,561,897 B1
(45) Date of Patent: May 13, 2003

(54) CASINO POKER GAME TABLE THAT IMPLEMENTS PLAY OF A CASINO TABLE POKER GAME

(75) Inventors: Feraidoon Bourbour, Minneapolis, MN (US); Troy D. Nelson, Big Lake, MN (US)

(73) Assignee: Shuffle Master, Inc., Eden Prairie, MN (US)

( * ) Notice: Subject to any disclaimer, the term of this patent is extended or adjusted under 35 U.S.C. 154(b) by 16 days.

(21) Appl. No.: 09/690,655

(22) Filed: Oct. 17, 2000

(51) Int. Cl.[7] ..... A63F 1/12; A63F 1/18

(52) U.S. Cl. ..... 463/13; 463/25; 463/46; 273/292; 273/309; 273/149 R

(58) Field of Search ..... 273/309, 274, 273/292, 149 R, 149 P, 138.2, 138.1; 463/25, 29, 46, 13

(56) References Cited

U.S. PATENT DOCUMENTS

| | | | |
|---|---|---|---|
| 4,743,022 A | | 5/1988 | Wood |
| 4,807,884 A | | 2/1989 | Breeding |
| 4,948,134 A | | 8/1990 | Suttle et al. |
| 5,013,049 A | | 5/1991 | Tomaszewski |
| 5,118,109 A | | 6/1992 | Gumina |
| 5,255,915 A | | 10/1993 | Miller |
| 5,261,667 A | | 11/1993 | Breeding |
| 5,275,411 A | | 1/1994 | Breeding |
| 5,294,128 A | | 3/1994 | Marquez |
| 5,303,921 A | | 4/1994 | Breeding |
| 5,314,194 A | | 5/1994 | Wolf |
| 5,356,145 A | | 10/1994 | Verschoor |
| 5,382,025 A | * | 1/1995 | Sklansky et al. |
| 5,407,199 A | | 4/1995 | Gumina |
| 5,415,404 A | | 5/1995 | Joshi et al. |
| 5,431,407 A | | 7/1995 | Hofberg et al. |
| 5,437,451 A | | 8/1995 | Fulton |
| 5,544,893 A | | 8/1996 | Jones et al. |

(List continued on next page.)

*Primary Examiner*—Benjamin H. Layno
(74) *Attorney, Agent, or Firm*—Mark A. Litman & Assoc. P.A.

(57) ABSTRACT

An apparatus and a method of play in the practice of the present invention that are described below. An apparatus supporting the play of a casino table card game according to the present invention may comprise: A playing surface; A card-delivery device; A microprocessor operatively connected to the card-delivery device; Player controlled election identifiers that provide a visible signal of an election; At least two areas for display of at least partial card hands from which only one card hand may be elected for a wagering game by a player; The card-delivery device having at least one sensor thereon for sensing the presence of cards in a delivery area of the card-delivery device from which cards may be removed; The at least one sensor on the card-delivery device providing a signal to the microprocessor that a sensed set of cards has been removed from the delivery area; and in response to the signal, the microprocessor preventing players from entering a new election. The apparatus delivery device is preferably a card-shuffling device. The card-shuffling device may both shuffle cards and create sets of predetermined, preselected numbers of cards to be used in play of a card game. The card-shuffling device may be capable of being programmed to provide sets of cards of different numbers of cards to be used in the play of a card game. The apparatus signal to the microprocessor could comprise a signal that a sensed set of cards has been removed from the delivery area is in response to removal of either a) at least a portion of a player's hand or b) at least a portion of common cards. The signal to the microprocessor that a sensed set of cards has been removed from the delivery area may be in response to removal of at least a portion or all of common cards to be used in play of a game. A method of using this apparatus also constitutes a practice of the present invention.

18 Claims, 10 Drawing Sheets

U.S. PATENT DOCUMENTS 5,573,249 A * 11/1996 Johnson
5,605,334 A * 2/1997 McCrea, Jr.
5,695,189 A 12/1997 Breeding et al.
5,718,430 A 2/1998 Aramapakul et al.
5,779,546 A * 7/1998 Meissner et al.
5,794,964 A 8/1998 Jones et al.
5,795,225 A 8/1998 Jones et al.
5,810,355 A 9/1998 Trilli
5,845,907 A 12/1998 Wells
5,941,769 A * 8/1999 Order
6,015,347 A 1/2000 Maahs et al.
6,019,368 A 2/2000 Sines et al.
6,039,650 A * 3/2000 Hill
6,068,258 A 5/2000 Breeding et al.
6,079,712 A * 6/2000 Eaton et al.

* cited by examiner

CASINO POKER GAME TABLE THAT IMPLEMENTS PLAY OF A CASINO TABLE POKER GAME

BACKGROUND OF THE INVENTION

1. Field of the Invention

The present invention relates to casino table poker games and to table designs and associated apparatus that implements, supports and enhances the play of the casino table poker game.

2. Background of the Art

The growth of the gaming industry, in particular, gambling casinos has been very significant over the last decade. The industry has come to recognize the need for new games and new gambling concepts. It also recognizes that the new technologies available need to be integrated in order to improve their gaming environment. It also recognizes the need to become a more efficient gaming provider.

The state gaming control boards of Nevada and New Jersey (which have traditionally been slow to approve any new games or gambling concepts) have changed their philosophy so dramatically that today they actively encourage the trial and acceptance of new games and gambling concepts. The problem with introducing new games has always been the basic criteria for mass-market gambling:

Easy-to-learn game rules.

Strategies must be easy to master and not favor an expert disproportionately.

Games must have a short duration between the start (the bet) and the finish (the payoff).

The payoff structure must be enticing to players.

The game must be sufficiently fair so that a player has an opportunity to win sometimes, and the casino should not have an unreasonable advantage.

The game must be susceptible to security and surveillance so that is protected from cheating and tampering.

The casino's hold or advantage must be demonstrated to be sufficiently worthwhile that a casino can afford to operate and maintain the game with a profit.

Over the years, there have been many different types of games that have attempted to satisfy the demands of the gaming industry. These games have ranged the gamut from those involving great mental prowess to games involving merely chance. Nevertheless, there is still a strong interest in game concepts that create real excitement.

More specifically, with many games the players are placed in the position of passive observers. This is actually most true of the more expensive games that employ electronic components and the like which may or may not involve any skill on the part of the player. Still further, the game development or play is almost always viewed as unrealistic (e.g., only involving luck) at best.

Because of this fact, such expensive games are often difficult to market and discarded after minimal play even when purchased by the consumer. Moreover, even when use continues, such games have consistently lacked any relationship to the excitement as well as the strategy and planning that should be the characteristic of any game. While it is generally recognized that decision making in game play is of paramount importance, there has yet to be a game that places players in a realistic decision making capacity.

One game of interest over the years is poker. Various attempts have been made to enhance play of poker over the years. Examples of such attempts are described in the following U.S. patent references, all of which are hereby incorporated by reference:

U.S. Pat No. 4,743,022, Wood, second chance poker method; U.S. Pat. No. 4,948,134, Suttle et al., electronic five card poker game where cards are given to the players one at a time; U.S. Pat. No. 5,013,049, Tomaszewski, five card poker game where up to two cards are drawn; U.S. Pat. No. 5,118,109 Gumina, instant poker game card; U.S. Pat. No. 5,255,915, Miller, six card, two hand video poker game; U.S. Pat. No. 5,294,128, Marquez, six cards, three hand poker game; U.S. Pat. No. 5,382,025, Sklansky et al., three hands, two card poker game where each player chooses one hand and five communal cards are dealt face up; U.S. Pat. No. 5,407,199, Gumina, interactive video/casino poker game-draw poker, hold'em poker; U.S. Pat. No. 5,415,404, Joshi et al., multiplay video poker game in which the player's sub-hands are compensated to increase the payoff level of the winning hands; U.S. Pat. No. 5,431,407, Hofberg et al., casino poker game.

U.S. Pat. No. 5,437,451 to Fulton involves a modified poker game where the player is dealt pairs of cards, where one card is optional and the other mandatory. The player is permitted to exchange at each round the optional card until five cards are selected. The resulting five card hand is then evaluated for payoff against a fairly standard payoff table.

U.S. Pat. No. 5,314,194 to Wolf deals the player seven cards. The player then forms two hands: a five card hand (e.g., a front hand), and a two card hand (e.g., a back hand). The rules for playing this game are quite elaborate, including requiring each player to arrange the hand so that the rank of the back hand is greater than the rank of the front hand.

U.S. Pat. No. 5,845,907 describes a casino table poker game comprising a method of playing a poker variation card game involving multiple wagers using a single standard deck of cards, with said game involving standard poker hand rankings and comprising the steps of:

each player placing a wager to participate in the game;

a dealer dealing cards face down to each player and at least one common card face down for use by all participating players;

giving each participating player the chance, before any discard, to inspect the cards the player received to determine if the cards qualify for the discard exception under certain specified conditions;

restricting all participating players whose initial cards do not qualify for the discard exception to the option to either play or fold;

requiring all players who wish to continue to play a hand to discard one of their cards and to make a second bet;

giving each player whose initial cards do qualify for the discard exception, the standard option to either fold or to discard and play, as well as the improved option to ignore the discard rules and declare the hand an immediate winner;

showing the common card(s) and determining the highest poker hand held by each player;

determining what payout, if any, each player is entitled to receive according to that player's wagers and the pre-selected payout schedule.

U.S. Pat. No. 5,718,430 describes a method of playing a poker game comprising one player being selected as a player-bank comprising the steps of:

the player-banker wagering a desired amount designated as the bank amount;

the other players wagering desired amounts each;

dealing three hole cards to each player;

each player discarding one of the three hole cards;

dealing five cards face up as common cards;

each player in turn, from a predetermined first player resolving his wager with the player bank based on poker hand priority by selecting the best five card hand of the seven cards consisting of the player's two hole cards and the five common cards; and wherein a higher hand wins over the player-bank and otherwise the player-bank wins.

Some of these games are variations of the standard poker game known as Hold'Em. The game of Hold'Em is described in *The Complete New Hoyle Revisited*, 1991, Doubleday, New York, N.Y., pages 24–25. The game is played with (usually, although in private games this is done by agreement) an ante bet made by each player before the players receive two cards, face-down. These are the player's hole cards or pocket cards. After the hole cards are dealt, the deck is temporarily put aside and a first betting interval occurs. After the first betting interval has occurred, the dealer provides three cards in the middle of the table, face-up. These three cards are called the-flop or the common cards. The deal is then again interrupted for a second betting interval. The dealer then provides a fourth card, face-up, followed by a third betting interval. At the end, the dealer provides a fifth card, face-up. The fifth card is followed by a betting interval. The player's construct the highest ranked five-card hands with their two hold cards and cards from the flop. The highest ranked hand is the winner. A variation of this game is Texas Hold'Em in which a button is passed around the table by the house dealer to designate players as the dealer for purposes of initiating wagers.

Some casinos attempt to construct games where players are not playing against each other. This is done to minimize adversarial conditions at gaming tables and because the ability of the house to control its take is limited to a rake from the betting, which is annoying to many players. A variation on Hold'Em known as Hold'Em challenge has been designed to make the game more acceptable to casinos and players, and this game is described in U.S. Pat. No. 5,382,025 (Sklansky). The underlying game is similar to Texas Hold'Em, with three sets of two player's cards dealt face-up to positions on the table, and five flop cards dealt face-down. The players then are able to bet, before viewing the flop cards, on which two-card player's hand will form the highest ranked hand in combination with the flop. The wager structure is designed to provide a sufficient return to the house while offering a sufficient frequency of wins to keep players interested in the game. Although the game has attracted the interest of players, there are significant security issues and game control issues in the play of the game, and apparatus needs to be designed to implement play of the game.

There is a significant amount of gaming apparatus that has been developed for use in the play of casino table games. The most successful addition to table gaming apparatus has been the automatic card shuffler, such as those invented by Shuffle Master Gaming, Inc. as represented by U.S. Pat. Nos. 4,807,884; 5,261,667; 5,303,921; 5,695,189; and 6,068,258. These automatic shuffling devices have increased the frequency of casino table card games being played and have increased security and control over cards in casinos. These devices have become more sophisticated and have increased sensing and monitoring capability, having microprocessors included within the devices. Additional shuffling apparatus with microprocessors, sensors, and more sophisticated electronics include U.S. Pat. Nos. 6,019,368; 5,810,355; 5,356,145; 5,275,411 and the like. These intelligent shufflers have the various capacities to detect jammed cards in the shuffler, count the number of cards dealt into individual player/dealer hands, assign cards to specific separation slots, and perform other tasks.

Other gaming apparatus that has been developed includes coin, token or wager sensing devices and jackpot display systems such as those described in U.S. Pat. Nos. 6,015,347; 5,795,225; 5,794,964 and 5,544,893. These types of systems indicate that a wager has been placed by a particular player for a particular type of wager. These bet indicating systems have been useful for particular casino table games, but they are not necessarily a universal solution for all issues in security and bet identification in all casino table wagering games.

BRIEF SUMMARY OF THE INVENTION

A system is specifically designed for enhancing the play of Hold'Em Challenge™ casino table poker (as described in U.S. Pat. No. 5,382,025). The game of Hold'Em Challenge casino table poker is played in casinos according to the following rules of play:

A wager (ante) to play in the game is placed by each player. In addition to the ante, the player also may make a (compulsory or optional) jackpot/bonus wager (the effect of which is explained in greater detail later). The house (e.g., a dealer that is not a playing participant in the game) distributes two hole cards each, face-up at three locations on the casino table, the cards usually being provided from a standard, fifty-two card deck. The house then provides five cards face-down as the flop. The individual players then elect or choose which of the hands of the three sets of hole cards is most likely to provide the highest rank five card hand in combination with the flop, when the flop is exposed. After the election is made (which also allows for the opportunity to double the ante wager), the flop is exposed, and the house determines which set of two hole cards provides the highest rank five card hand in combination with the flop. Those players who wagered on the correct hand forming the highest rank hand win their ante and any additional bet. If the player placed a side wager, and if the hand rank produced by the flop and the players' selected set of hole cards achieves at least a predetermined high rank (e.g., at least three-of-a-kind, straight, flush, full house, four-of-a-kind, straight flush or royal flush), the jackpot/bonus wager is paid off at a factored rate (e.g., three-of-a-kind at 3:1, straight at 4:1, flush at 5:1, full house at 8:1, four-of-a-kind at 50:1, straight flush at 100:1 or royal flush at 250:1). Preferably the bonus awards are paid when a predetermined high rank is achieved, even if the hand is not determined to be the highest rank hand. In one example, the player must use both selected hole cards to form a winning bonus hand. In other examples, the player is required to use one or none of his hole cards to form a winning bonus hand.

This structure of the game has the players playing against the house and not against each other, and offers the appearance of a relatively high level of success, while providing a reasonable return to the house. The only problem with the game is the need for security with respect to the definition of wagers and the certification of the election of one of the three hands made by each player. As the dealer cannot be constantly focused on the placement of wagers and the position of placed wagers by each player (as he must manipulate cards, make change, etc.), there is an opportunity for players to rearrange the choice of winning hole cards, and therefore increase the risk of cheating during the game.

The present invention provides a table designed for play of the game Hold'Em Challenge™ casino table poker with electronics, including visible markers, that indicate where each player positions his selection of the hole cards. In addition, the shuffler is electronically linked and actively linked to the electronics on the casino table to lock in/lock out wagers and elections that have been made during the play of the game.

DETAILED DESCRIPTION OF THE INVENTION

Figure 1:
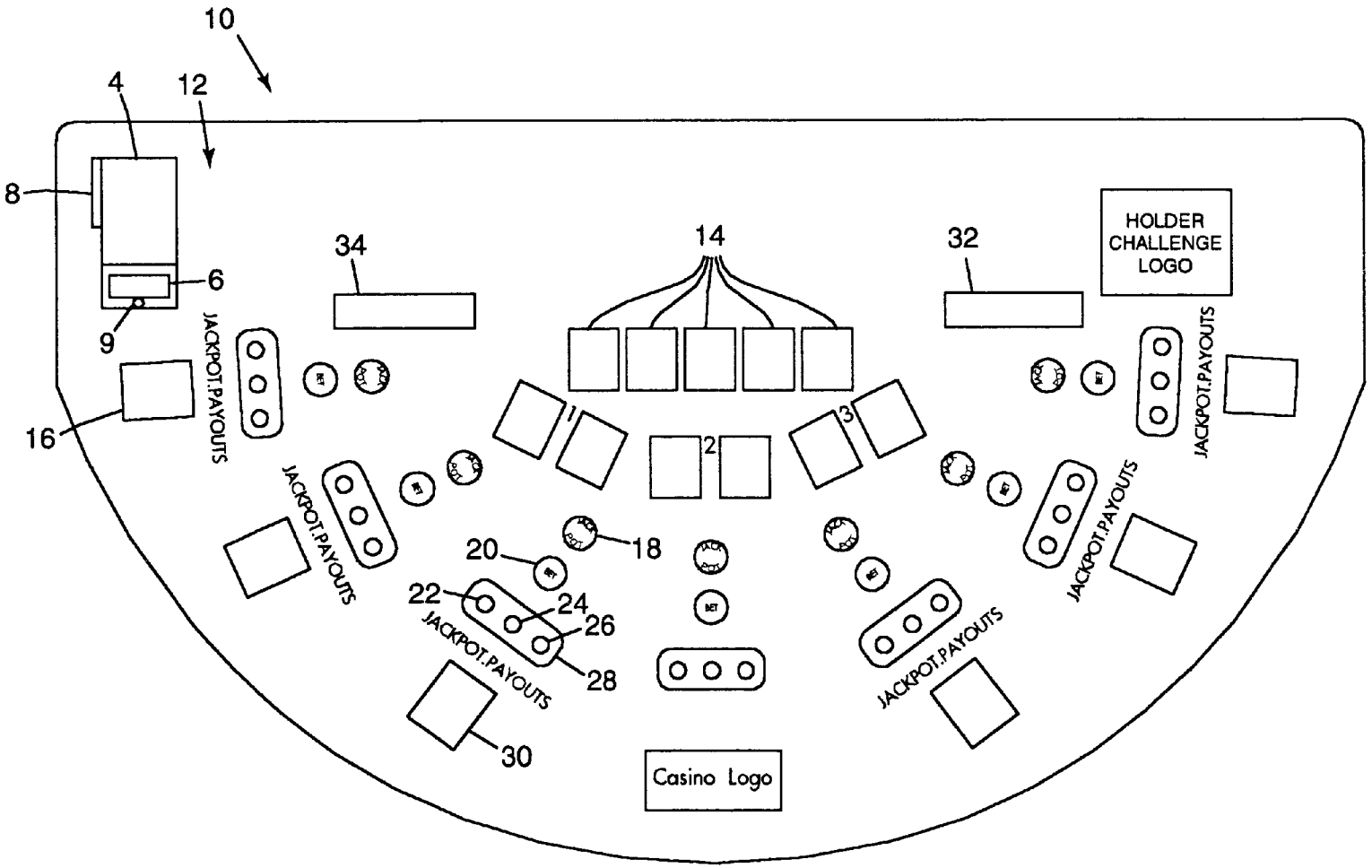
FIG. 1 shows a table layout for the game of Hold 'Em Challenge™ poker according to the present invention.

A shuffler-casino table construction is provided with both game function abilities and security capability for locking-in/locking out elections made by a player. The underlying apparatus comprises a casino table with election indicators, visual indicators identifying an election, a shuffling device, a microprocessor, and a control system for the visual indicators. The microprocessor is actively linked to the shuffling device (it may actually be embedded in the shuffling device) and the visual indicators.

Each player position is provided with a set of visual election indicators. These are conveniently provided as three light panels or one panel with three distinct lights (e.g., each light separately associated with one of the three sets of hole cards). The distinct lights may be numbered to associate them with each of the three sets of hole cards, have different colors, or just be positioned (three-in-a-row)-to associate the visual indicators with a specific set of hole cards. The player is provided with a control function to designate which set of hole cards is elected, the control function causing one visual indicator at the player position to be distinct from the other indicators. This distinction may be that the elected set indicator is lit, while the others are not, the elected set indicator is unlit while the others are lit, the elected indicator is lit with a different color than the set indicators for non-elected sets, a token or chip may be gripped in place at a selected indicator position, may raise or lower a flag or pin at the selected set of hole cards indicator position, and the like.

The player places one or two distinct wagers on the table, a mandatory ante bet and an optional jackpot/bonus wager (the preferred method of play is to have the jackpot/bonus wager optional, but the game may be played with that wager as mandatory, or even left out of the play of the game). The jackpot/bonus wager enables the player to receive bonus payments for achieving hands of predetermined ranks (e.g., bonuses for royal flushes, straight flushes, four-of-a-kind, full house, flushes, straights, three-of-a-kind, etc.). At any time after the three sets of hole cards are displayed, the players may select which of the three sets of hole cards they will wager on as the hand that when combined with the flop cards, is most likely to provide the highest rank hand (as compared to the remaining two sets of hole cards). The wager may be allowed before the flop is positioned face-down, while the flop is being positioned face-down, or after the flop has been positioned face-down. The election is made by varying the visual characteristics between the three hole card set indicators. The change may be effected by directly contacting one or more indicators (to light or darken a light, raise or lower a flag, etc.) or by pressing a button or throwing a switch adjacent to or connected to the visual indicator. The player may alter the election for a given amount of time. It is an aspect of the invention that this time for altering election is controlled directly through the operation of the shuffler. This can be effected in a number of different ways.

One way in which the shuffler and its associated microprocessor can control the ability of players to enter selections of elections is for the flop cards to be positioned at a specific location in the shuffler, such as in a dealer delivery tray, after the three sets of hole cards have been dealt. Before the flop is so positioned and during the time the flop is so positioned, the player selection functions are open, selections may be entered, and selections may be changed. As soon as one or more or all of the flop cards have been removed from the specific location, the shuffler alerts the visual indication system that selection may no longer be altered. The dealer or the shuffler does not remove cards from the specific location (e.g., referred to as a triggering site, staging site, flop tray, dealer delivery tray, or the like) at least until each player has made a selection or election among the three sets of hole cards. Although certain shuffling devices (e.g., the Shuffle Master, Inc.'s Ace® shuffler) have been retrofitted or built with a manually operated button that locks out players' direct wagers (e.g., as in the games of Let It Ride® poker and Caribbean Stud® poker), but there have been no automatic signals provided by a shuffler that control wagers, and no signals that control non-wager activities (e.g., selection of an option after the wager has been committed). Upon removal of the flop cards from the flop tray or specific location in the shuffler, all selections having been made are then locked-in and all alterations or new player entries into that game are locked-out.

Another way in which the shuffler may operate to limit or override the election by players is for the shuffler to count the cards that pass through the shuffling system and compare that number to a predetermined number. The shuffler senses the movement of the individual cards through the apparatus, counts the cards, and compares that count to a predetermined number (e.g., fifty-two for a standard playing card deck). If the count corresponds to the predetermined number, the normal play of the game and the lock-in/lock-out control continues. If there is no such correspondence, a signal is provided. In such games as Let It Ride® poker and Caribbean Stud® poker, a visual signal has been provided that the count is correct (green light) or that there is no correspondence in the count (red light). In the present game, an automatic secondary lock-out is applied that prevents the system, even upon attempted direction by the dealer, from identifying a winning hand at the player visual indicator positions. Again, the prior art systems are believed to do no more than provide a visual signal to the dealer/house that there is a lack of correspondence between the number of cards counted and the predicted (predetermined) number.

The general play of the game of Hold'Em Challenge casino table poker is described in more detail in U.S. Pat. No. 5,382,025 (Sklansky) as a method of playing a poker game, comprising the steps of:

dealing at least three hands each consisting of a first predetermined number of cards including at least one face-up card;

requiring one or more players, after viewing said hands, to each select one of said hands;

turning face-up a second predetermined number of at least one communal card; and comparing each of said hands, in conjunction with said at least one communal card, using poker rank as the criterion for comparison to determine a winning hand; and designating as a winner each player who selected said winning hand.

The game of Texas Hold'Em and Hold'Em Challenge poker are described in more detail by Sklansky as a poker game variation in which one or more players play against the house, the player(s) place bets and then three face-up hands consisting of two cards each are dealt. Player(s) each choose one of the three hands and then five communal cards are dealt face-up. In a first embodiment, all five communal cards are dealt face-up at one time, and then the winning hand(s) are determined by comparing the three hands in conjunction with the communal cards using poker rank as the criterion for comparison. Each player betting on the winning hand wins his or her bet. In a second embodiment, three of the five communal cards are turned face-up, after which all players have the option of surrendering one-half of their bet and folding. After the surrender opportunity, the remaining two communal cards are turned face-up and the winning hand determined using poker rank as the criterion for comparison. A third embodiment is identical to the second embodiment, with the exception that winning players are paid a bonus amount depending upon the poker rank of the winning hand. For example, a royal flush pays 50 to 1, a straight flush pays 20 to 1, etc. A novel gaming table layout for use in the live casino versions of the game is also used. A typical payout schedule would be as follows:

Royal Flush 250–1000 to 1

Straight Flush 20–100 to 1

4 of a Kind 20–50 to 1

Full House 8–15 to 1

Flush 5–10 to 1

Straight 4–7 to 1

3 of a Kind 2–5 to 1

Two Pair 1–2 to 1

Pair of 9's or Better 1 to 1

It has become a very important component of the marketing and continued play of casino games to have attractive tables, playing surfaces that assist in easy understanding of the game, yet provide very strong security controls for the house. The following description provides an example of a table according to the teachings of the present invention that satisfies these goals. Although the table is described with respect to the game of Hold'Em and specifically Hold'Em Challenge casino table poker, there are definite features in the apparatus that have more general applicability to other casino table games.

There is both an apparatus and a method of play in the practice of the present invention that are described below. An apparatus supporting the play of a casino table card game according to the present invention may comprise:

a. A playing surface;

b. A card-delivery device;

c. A microprocessor operatively connected to the card-delivery device;

d. Player controlled election identifiers that provide a visible signal of an election;

e. At least two areas for display of at least partial card hands from which only one card hand may be elected for a wagering game by a player;

f. The card-delivery device having at least one sensor thereon for sensing the presence of cards in a delivery area of the card-delivery device from which cards may be removed;

g. The at least one sensor on the card-delivery device providing a signal to the microprocessor that a sensed set of cards has been removed from the delivery area; and h. In response to the signal, the microprocessor preventing players from entering a new election.

The apparatus delivery device is preferably a card-shuffling device. The card-shuffling device may both shuffle cards and create sets of predetermined, preselected numbers of cards to be used in play of a card game. The card-shuffling device may be capable of being programmed to provide sets of cards of different numbers of cards to be used in the play of a card game. The apparatus signal to the microprocessor could comprise a signal that a sensed set of cards has been removed from the delivery area is in response to removal of either a) at least a portion of a player's hand or b) at least a portion of common cards. The signal to the microprocessor that a sensed set of cards has been removed from the delivery area may be in response to removal of at least a portion of or all of common cards to be used in play of a game.

The player controlled election identifiers that provide a visible signal of an election may comprise a light emitting or light-transmitting system that can be turned on or off by a player's action. Pressure-activated contacts (e.g., touch pads, buttons, switches) may comprise the player controlled election identifiers.

A method of playing a casino table card game according to the present invention may comprise:

dealing at least three hands each consisting of a first predetermined number of cards including at least one face-up card;

requiring one or more players, after viewing said hands, to each select one of said hands by activating a mechanical indicator;

removing a second predetermined number of at least one communal card from a mechanical card-delivery system and turning face-up at least one of the second predetermined number of at least one communal card;

the card-delivery system signaling the mechanical indicator that the selection of one hand by activating a mechanical indicator may not be altered;

comparing each of said hands, in conjunction with said at least one communal card, using poker rank as the criterion for comparison to determine a winning hand; and designating as a winner each player who selected said winning hand. The method may have the card-delivery system signal the mechanical indicator in response to removal of a predetermined set of cards from the card-delivery system. The predetermined set of cards may comprise at least a portion or all of the at least one communal card. The mechanical indicator may respond to the signals by altering light-emitting characteristics. The at least three hands may each consist of two face-up cards and the at least one communal card may comprise at least three cards. A preferred method has three hands dealt, each hand consisting of two face-up cards and the at least one communal card comprises five cards.

FIG. 1 shows a table layout 10 for the game of Hold'Em Challenge casino table poker. The table 10 has a playing surface 12 on which are shown elements of the design for the game. A position 14 is available for the flop (cards not shown), and three separate positions (1, 2, and 3) for the sets of hole cards (not shown) are provided on the playing surface 12. There are also seven player positions 16 provided on the table 10. Three position selection visual indicators, here shown as lights 22, 24, and 26 are shown on a table insert 28. In front of the table insert 28 are two distinct bet positions 18 and 20. The first bet position 18 is for the placement of the required (or in a less preferred embodiment, optional) jackpot/bonus wager. This wager must be at a level equal to or exceeding the minimum wager allowed in the play of the game. Behind the first bet position 18 for the jackpot/bonus wager is a second bet position 20 for placement of the required entrance bet or ante. Other optional features shown on the playing surface 12 are a list of jackpot payout odds 30, a printed indication of the range of wagers allowed from minimum to maximum levels 32, and an area for patent marking 34. A shuffling device 4 with flop cards 6 is shown. The microprocessor 8 associated with the shuffling device 4 and a sensor 9 for sensing the presence of the flop cards 6 is also shown on the system. The software program and under the table electrical connections to the selection visual indicators are not shown.

A description of one form of the play of the game is as follows. Players (not shown) place both a mandatory bets and jackpot/bonus wagers on their appropriate positions (18, 20, respectively). The shuffler then provides three sets of two cards each, and these hole cards are positioned (in any order) at hole card sites 1, 2 and 3 with the faces of the cards (not shown) displayed, face-up. The software at this stage allows players to select which hole card set (or site) they hope to provide a five-card hand having the highest poker rank in combination with the flop cards (which have not necessarily been dealt, and definitely have not been placed face-down at flop card position 14. Each player presses one of the buttons 22, 24 or 26 that correspond to hole card sets 1, 2 and 3, respectively to identify their choice. The buttons 22, 24 or 26 light up when pressed. The buttons 22, 24 or 26, while the flop cards 6 are still sensed as within the shuffling device 4, may be pressed repeatedly to change the selection. The player may increase the amount wagered on the bet (not on the jackpot/bonus wager) by placing additional chips (not shown) placed adjacent to the bet position 20. This optional doubling of the bet is preferably allowed only when the selected card set is a pair, and must be done at some time before the dealer has displayed all of his cards. It is possible to allow doubling of the bet when less than all of the flop cards (especially no cards) have been displayed. When the cards 6 are removed from the shuffling device 4 and placed onto flop card positions 14 and this removal is sensed by sensor 9, the sensed removal is signaled to the microprocessor 8, and the microprocessor locks out the ability of the buttons 22, 24 or 26 when pressed to change the selection or visual indication of the chosen hole card set among 1, 2 and 3.

Figure 2:
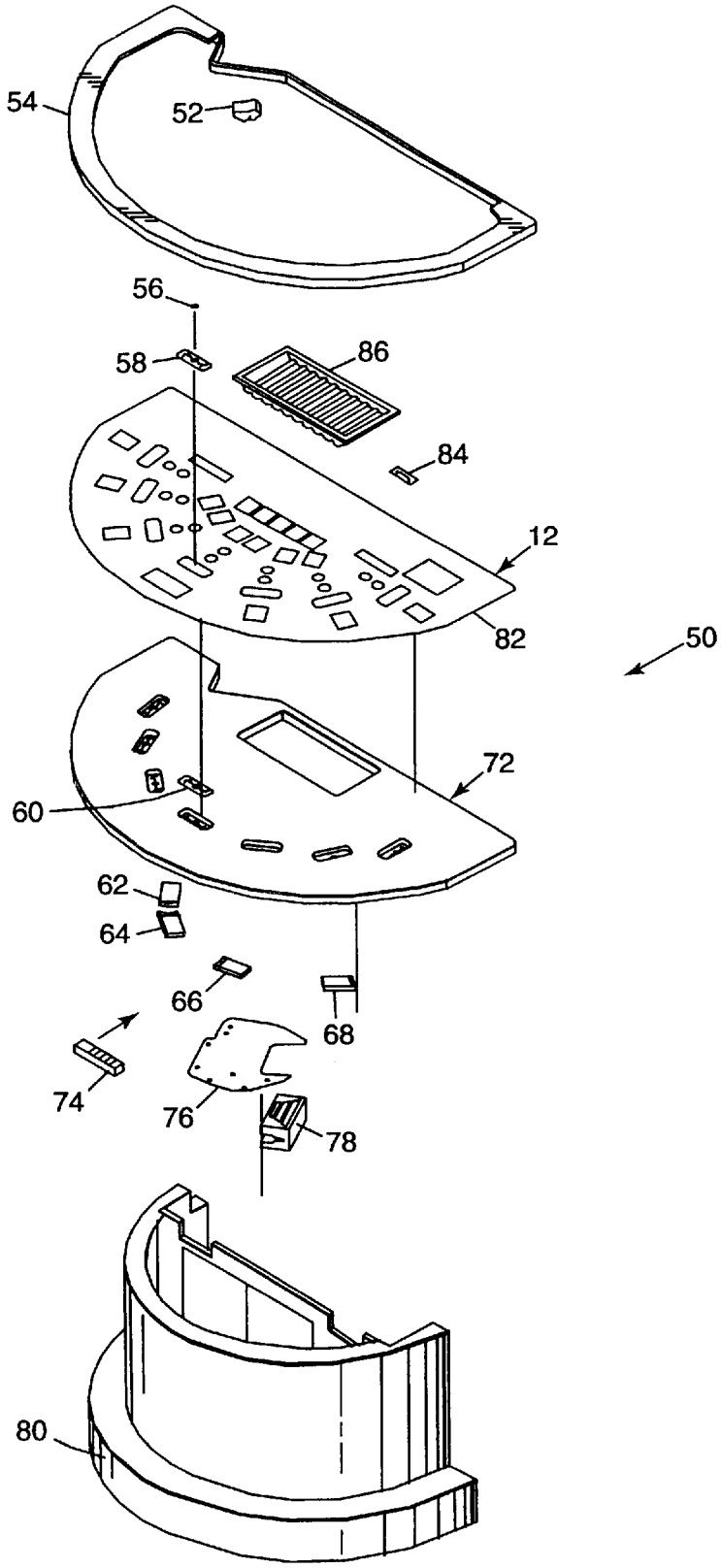
FIG. 2 shows an exploded view of a gaming table designed for use with the game of Hold 'Em Challenge™ poker.

FIG. 2 shows an exploded view of a gaming table 50 designed for use with the game of Hold'Em Challenge casino table poker. The parts are listed in a separate Table I below and are also shown in FIG. 2. A discard rack 52 is shown within the table ring 54. A protective cover 56 for the three light button panel 60 with three translucent bezel button holes 58 are shown elevated from the playing surface 12. Underneath the button holes 58 and three light button panel 60 are shown a cable assembly 64 with eight conductor leads for the Hold'Em, Challenge casino table poker game, another two cable assemblies 66 and 68, and a harness assembly 62. Associated with the cable assemblies 64, 66, and 68 and the harness assembly 62 are also PC board assemblies 70 for a motherboard (not shown) in the control system for the game and a PC board assembly 72 for a daughter board (not shown). An electrical outlet strip with noise suppression 74 is also provided. An shuffler extension plate 76 is shown supporting a keypad assembly 78 with a protective membrane overlay (not shown) that allows activation and control of the visual indicating system. A support base 80 for the table 50 is also shown to support the layout surface 82 for the game. Other accessories shown are a bill slot opening 84, and a chip tray 86.

Figure 3:
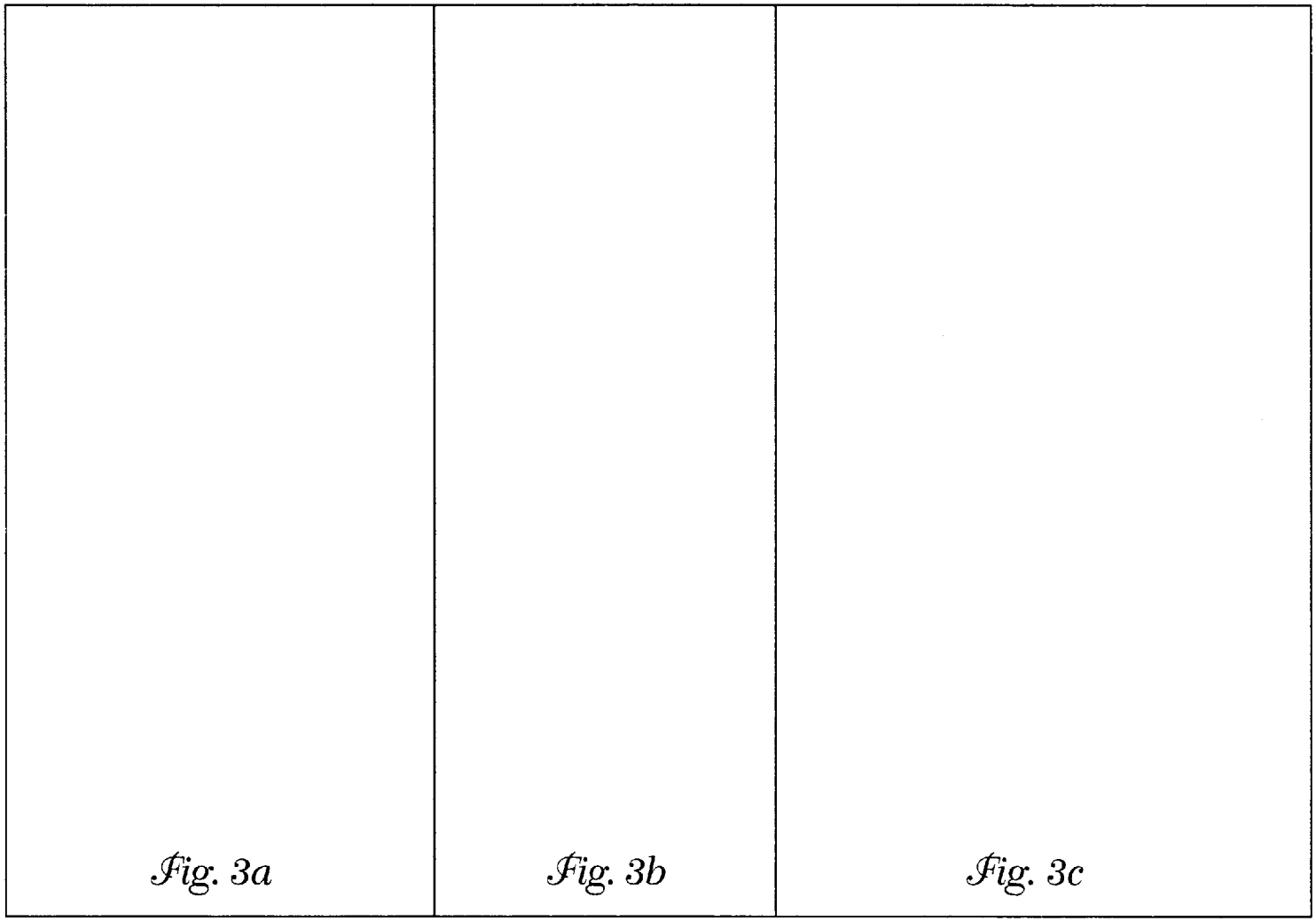
FIGS. 3*a*, 3*b* and 3*c* show circuitry for a motherboard useful in the implementation of the invention.
Figure 3A:
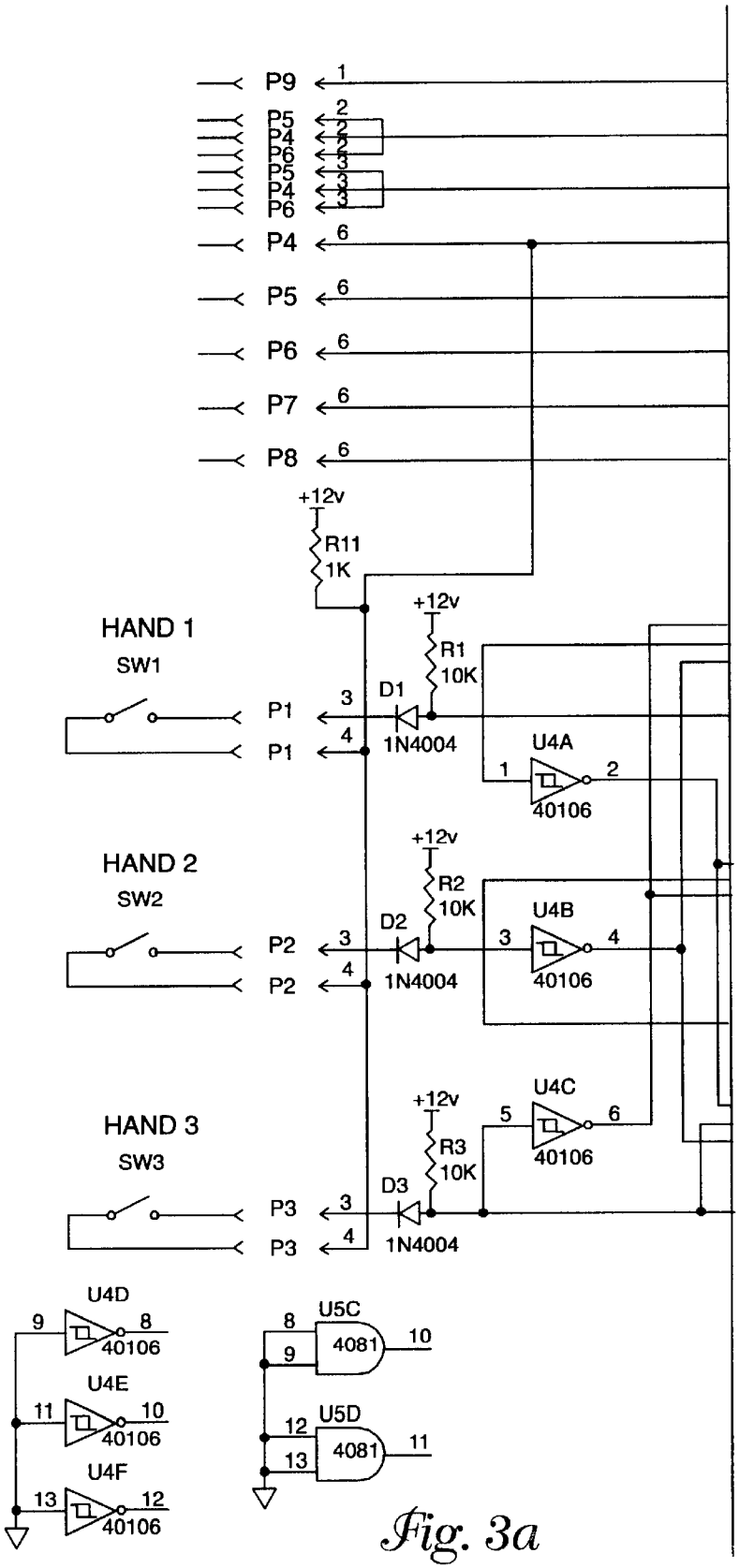
Figure 3B:
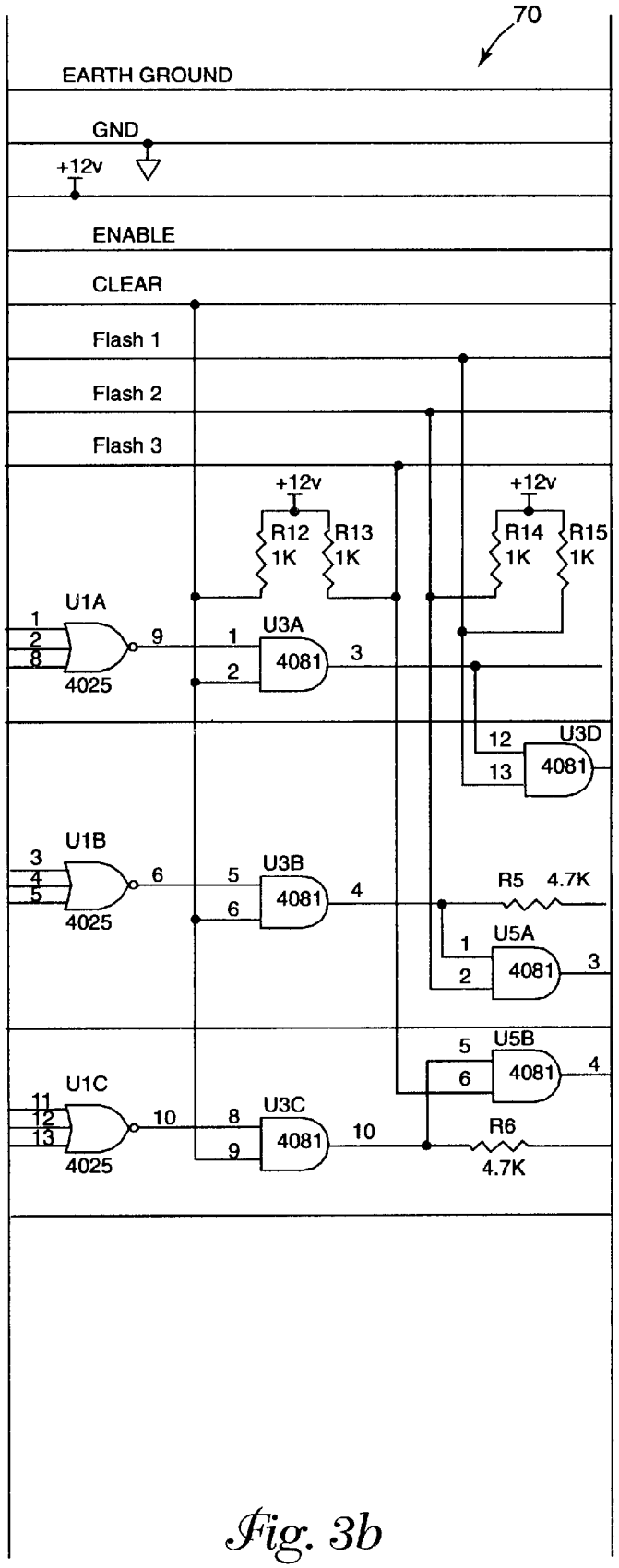
Figure 3C:
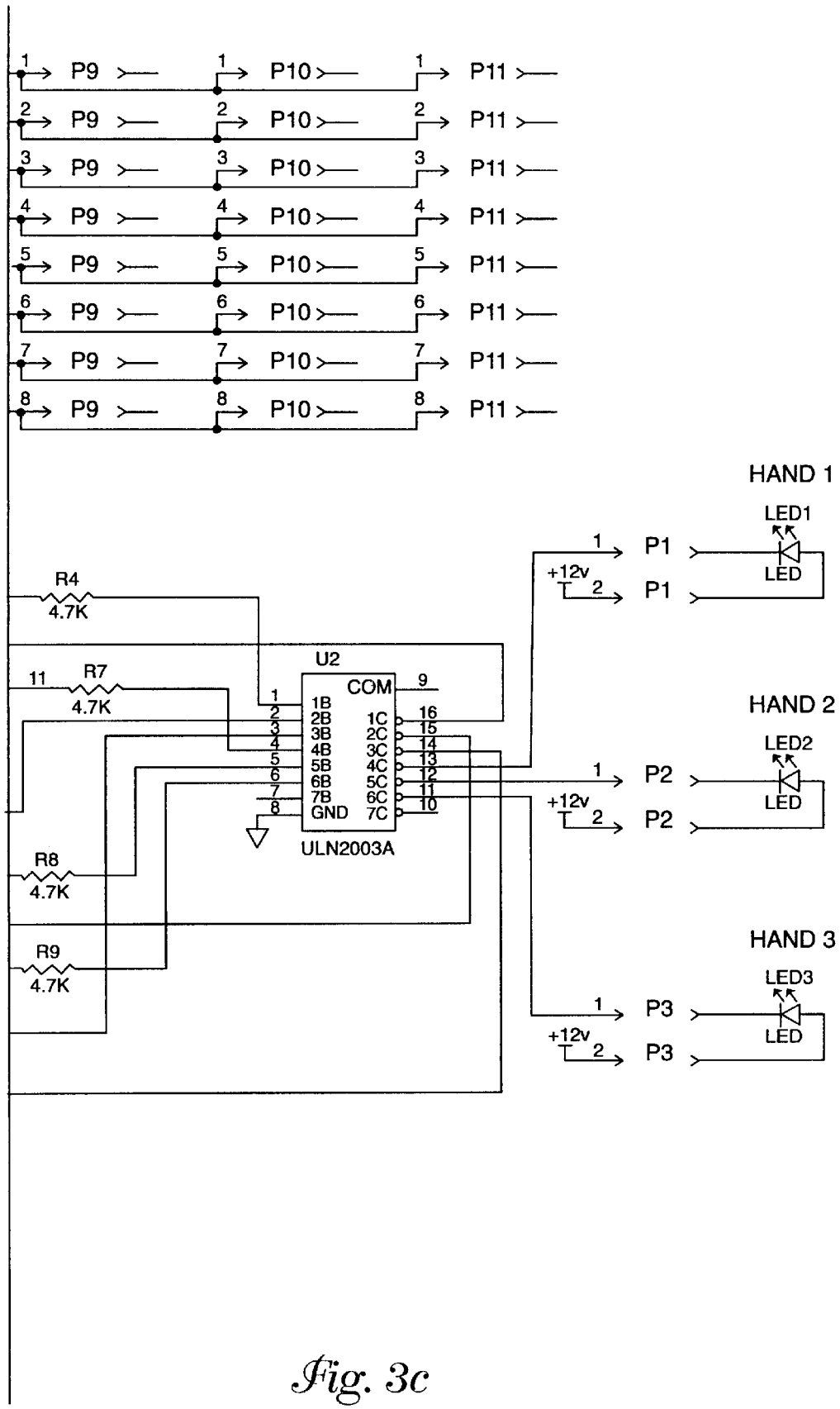
Figure 4:
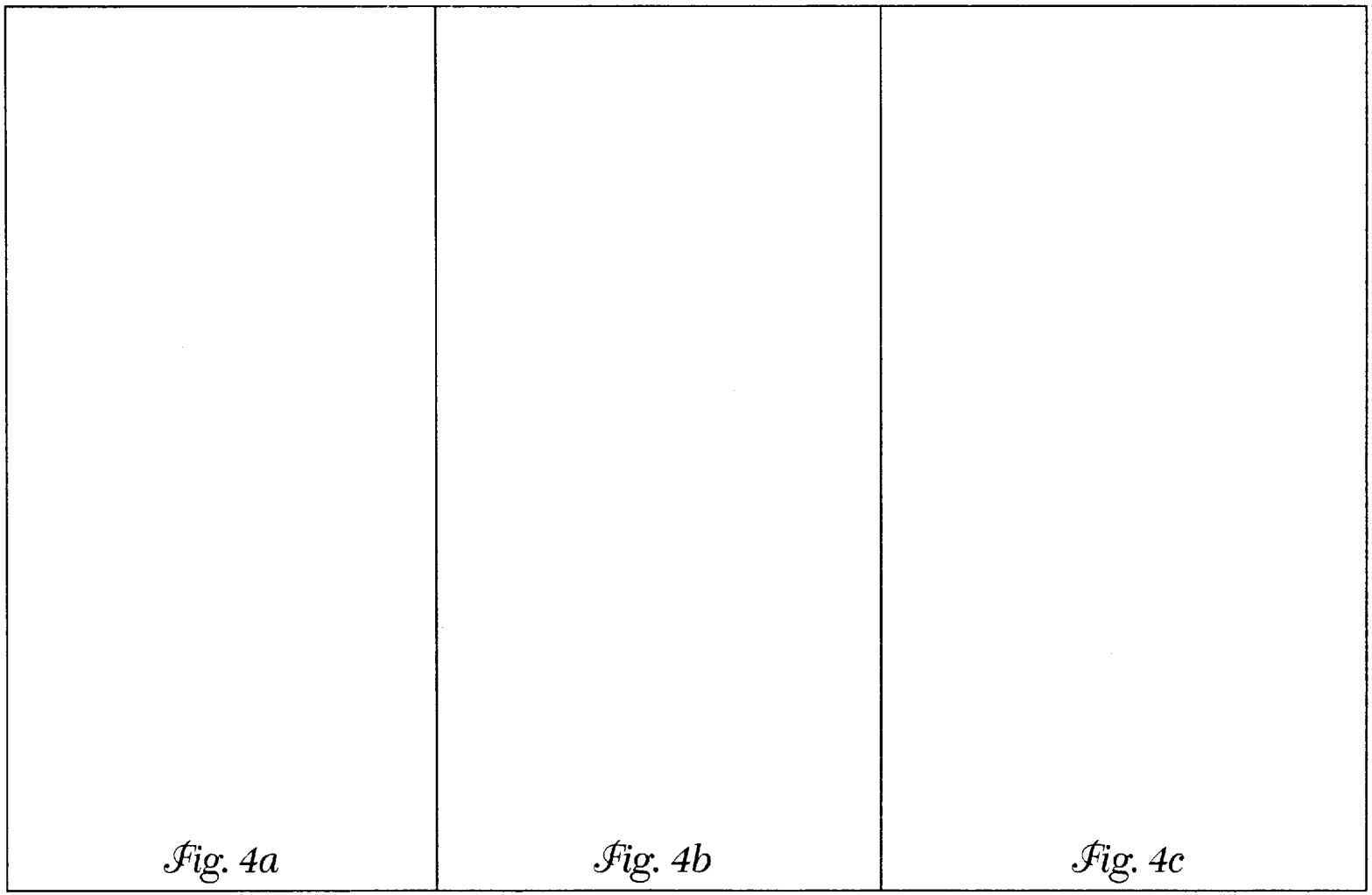
FIGS. 4*a*, 4*b* and 4*c* shows circuitry for a daughterboard useful in the implementation of the present invention."
Figure 4A:
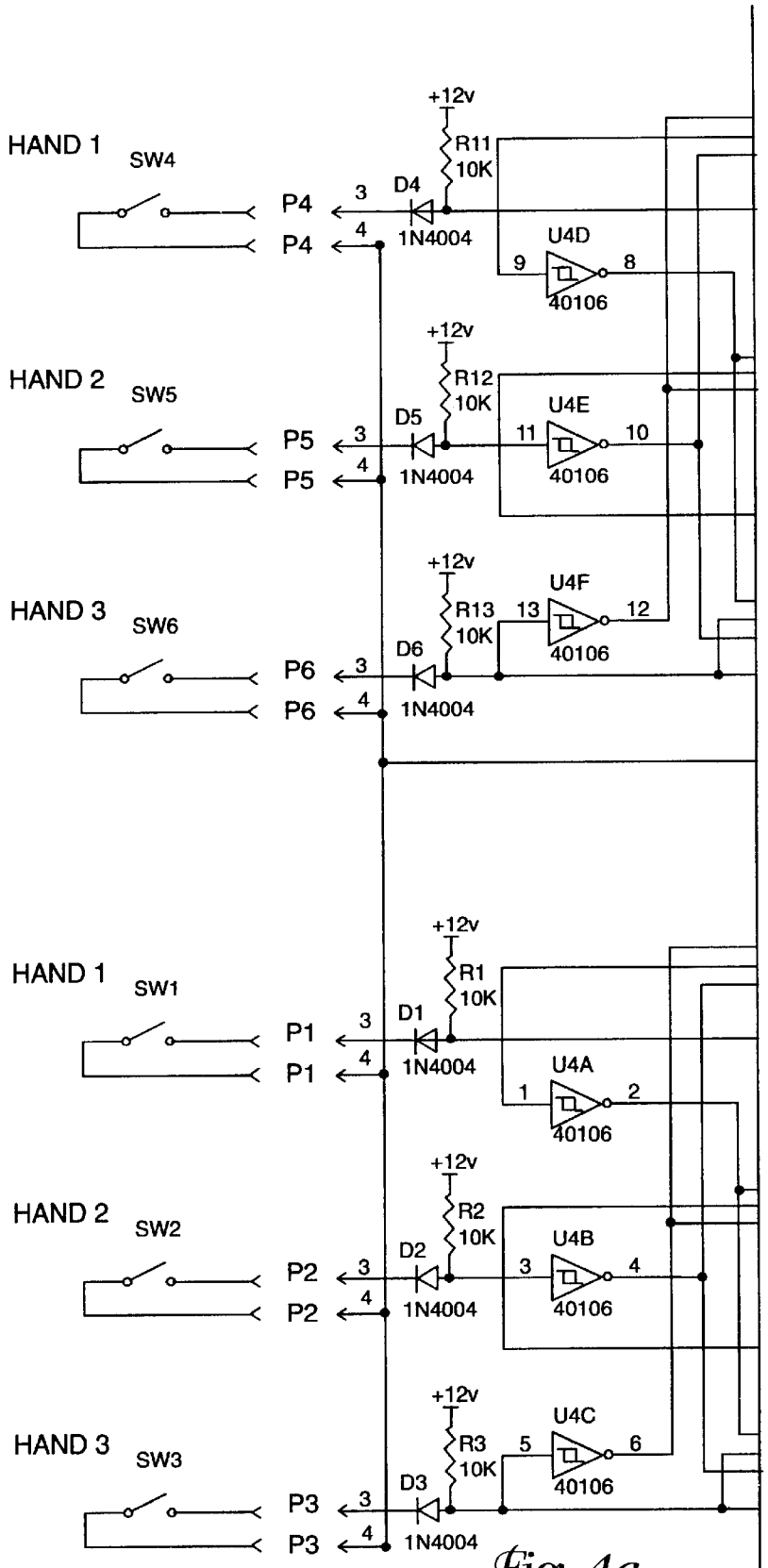
Figure 4B:
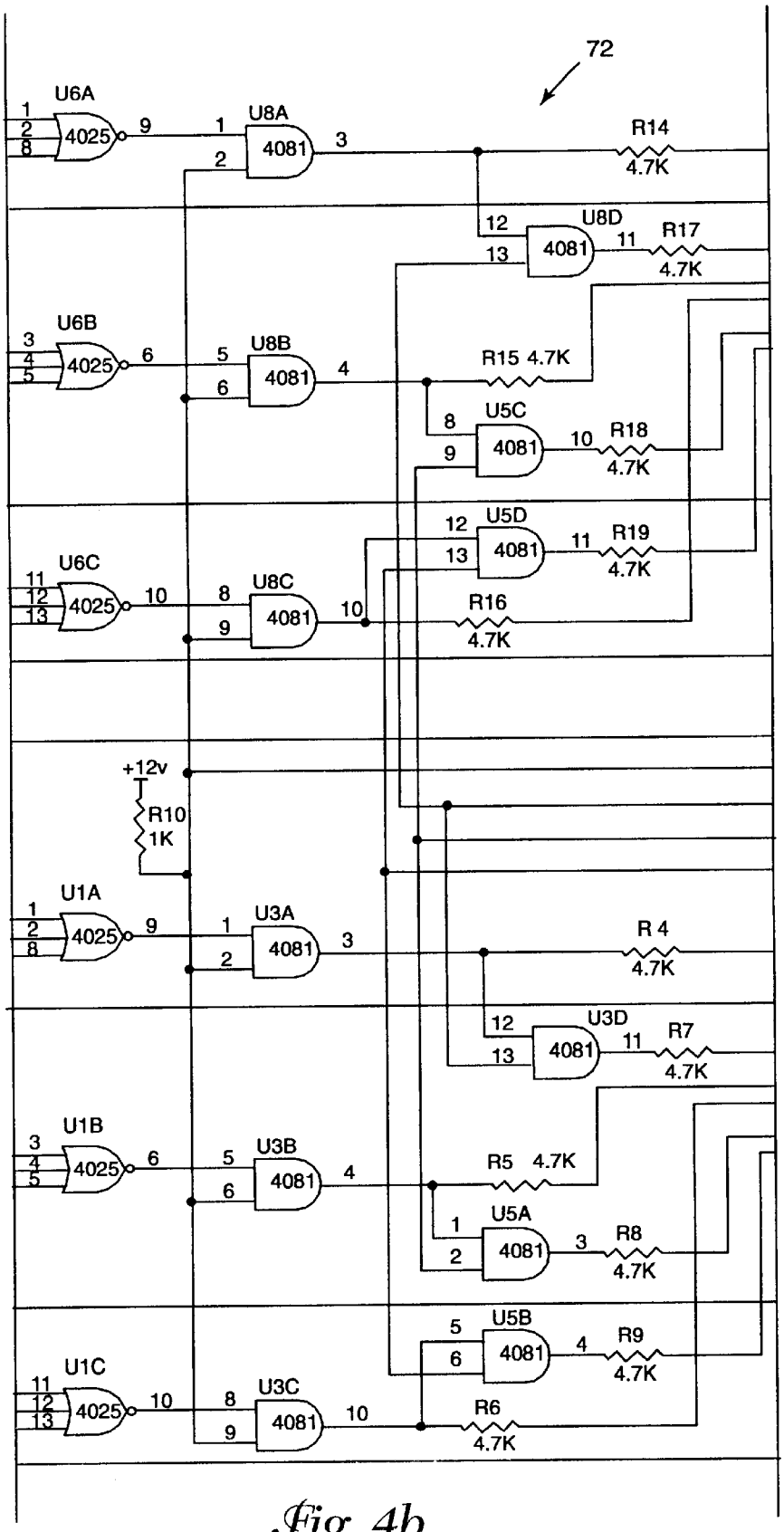
Figure 4C:
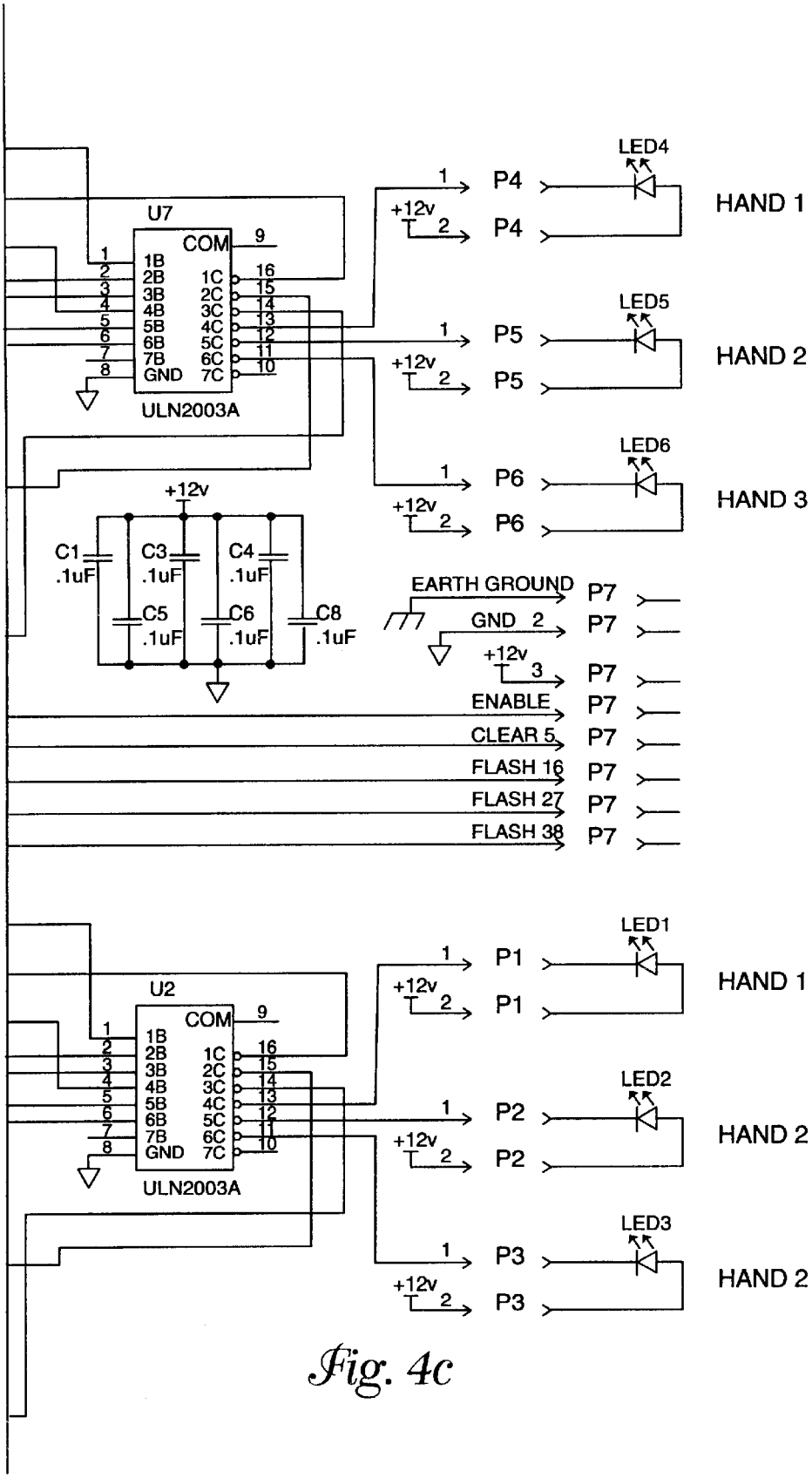

FIG. 3 shows the circuitry for a mother board, and FIG. 4 shows the circuit for a daughter board.

| Number on Figures | Parts Description |
|---|---|
| 80 | Table Base |
| 76 | Keypad Assembly |
| 74 | Outlet Strip, with Noise Suppression |
| 72 | PCB Board Assembly, Daughterboard |
| 68 | Cable Assembly, Conductor |
| 66 | Cable Assembly, Conductor |
| 64 | Cable Assembly, Conductor |
| 70 | PC Board Assembly, Motherboard |
| 62 | Harness Assembly |
| 60 | Three Button Assembly |
| 72 | Table Top |
| 58 | Three Button Bezel |
| 56 | Protective |
| 54 | Table Ring |
| 52 | Discard Rack |
| 86 | Chip Tray |
| 84 | Bill Slot Frame |
| 82 | Hold'Em Challenge layout |

What is claimed:

1. An apparatus supporting the play of a casino table card game comprising:

a. a playing surface;

f. a card-delivery device;

g. a microprocessor operatively connected to the card-delivery device;

d. player controlled electronic election identifiers that provide a visible signal of an election;

e. at least two areas for display of at least partial card hands from which only one card hand may be elected for a wagering game by a player;

f. the card-delivery device having at least one sensor thereon for sensing the presence of cards in a delivery area of the card-delivery device from which cards may be removed;

g. the at least one sensor on the card-delivery device providing a signal to the microprocessor that a sensed set of cards has been removed from the delivery area; and h. in response to the signal, the microprocessor preventing players from entering a new electronic election.

2. The apparatus of claim 1 wherein the card-delivery device is as card-shuffling device.

3. The apparatus of claim 2 wherein the card-shuffling device both shuffles cards and creates sets of cards to be used in play of a card game.

4. The apparatus of claim 3 wherein the card-shuffling device can be programmed to provide sets of cards of different numbers of cards to be used in the play of a card game.

5. The apparatus of claim 2 wherein the signal to the microprocessor that a sensed set of cards has been removed from the delivery area is in response to removal of either a) at least a portion of a player's hand or b) at least a portion of common cards.

6. The apparatus of claim 5 wherein the signal to the microprocessor that a sensed set of cards has been removed from the delivery area is in response to removal of at least a portion of common cards to be used in play of a game.

7. The apparatus of claim 5 wherein the signal to the microprocessor that a sensed set of cards has been removed from the delivery area is in response to removal of all available common cards to be used in play of a game.

8. The apparatus of claim 5 wherein the player controlled election identifiers that provide a visible signal of an election comprise a light emitting or light-transmitting system that can be turned on or off by a player's action.

9. The apparatus of claim 8 wherein pressure-activated contacts comprise the player controlled election identifiers.

10. The apparatus of claim 2 wherein the player controlled election identifiers that provide a visible signal of an election comprise a light emitting or light-transmitting system that can be turned on or off by a player's action.

11. The apparatus of claim 10 wherein pressure-activated contacts comprise the player controlled election identifiers.

12. A method of playing a casino table card game comprising:

dealing at least three hands each consisting of a first predetermined number of cards including at least one face-up card;

requiring one or more players, after viewing said hands, to each select one of said hands by activating an indicator;

removing a second predetermined number of at least one communal card from a mechanical card-delivery system and turning face-up at least one of the second predetermined number of at least one communal card;

the card-delivery system signaling the indicator that the selection of one hand by activating a mechanical indicator may not be altered;

comparing each of said hands, in conjunction with said at least one communal card, using poker rank as the criterion for comparison to determine a winning hand; and designating as a winner each player who selected said winning hand.

13. The method of claim 12 wherein the card-delivery system signals the mechanical indicator in response to removal of a predetermined set of cards from the card-delivery system.

14. The method of claim 13 wherein the mechanical indicator responds to the signals by altering light-emitting characteristics.

15. The method of claim 14 wherein the at least three hands each consisting of two face-up cards and the at least one communal card comprises at least three cards.

16. The method of claim 14 wherein three hands are dealt, each hand consisting of two face-up cards and the at least one communal card comprises five cards.

17. The method of claim 12 wherein the predetermined set of cards comprises at least a portion of the at least one communal card.

18. The method of claim 17 wherein the predetermined set of cards comprises a set of communal cards.

* * * * *